US005203369A

United States Patent [19]

Hwang

[11] Patent Number: 5,203,369

[45] Date of Patent: Apr. 20, 1993

[54] SINK-TRAP

[76] Inventor: Jin-Chyuan Hwang, No. 149 (Room 9, 10/F.) Lin Sen Road, Sec. 1, Tainan, Taiwan

[21] Appl. No.: 961,416

[22] Filed: Oct. 15, 1992

[51] Int. Cl.[5] ..... F16K 13/10

[52] U.S. Cl. ..... 137/247.39; 4/679

[58] Field of Search ..... 137/247.11, 247.35, 137/247.39; 4/679, 681

[56] References Cited

U.S. PATENT DOCUMENTS

| | | | |
|---|---|---|---|
| 978,485 | 12/1910 | Putnam | 137/247.35 |
| 2,074,462 | 3/1937 | Dame | 137/247.39 |
| 2,113,721 | 4/1938 | Dame | 137/247.39 X |
| 4,045,346 | 8/1977 | Swaskey | 137/247.39 X |

FOREIGN PATENT DOCUMENTS

| | | | |
|---|---|---|---|
| 18606 | of 1888 | United Kingdom | 137/247.39 |

*Primary Examiner*—John Rivell

[57] ABSTRACT

A sink trap having a generally semi-global main chamber, a shallow water chamber, a plurality of baffles for supporting the water chamber in the main chamber in an inwardly spaced relation and define a plurality of volute passageways between the main and water chambers and a cap detachably secured to the upper edge of the main chamber and an inlet pipe extending axially downwardly through the cap into the water chamber to lead drainage into the water chamber and discharging the drainage by overflowing the water chamber to flow through the volute passageways forming a turbulent liquid flow along a drainage pipe line to prevent the drainage pipe line from becoming choked with impassable matter.

2 Claims, 3 Drawing Sheets

SINK-TRAP

BACKGROUND OF THE INVENTION

1. Field Of The Invention

The present invention relates to improvements in traps adapted to be attached to a waste-pipe leading from a sink or other similar receptacle.

2. Prior Art

U.S. Pat. No. 460,557 to Carroll discloses a sink-trap comprising a main chamber having a circular recess in the upper edge for sustaining laterally-extending lips of a water-chamber, outlet ports located in the upper portion of the water-chamber and opening into the main chamber and a cap detachably secured to the upper edge of the main chamber for an object to provide means for preventing sewer-gas and other obnoxious vapors from passing up through the waste-pipe and out of the sink. The water-chamber of this known art is so deep that it may become chocked with impassable matter and needs to be inspected and cleaned periodically by removing the cap.

SUMMARY OF THE INVENTION

Accordingly, it is an object of this invention to provide an improved sink-trap which will overcome the disadvantages noted heretofore.

With the above objective in view, an improved sink-trap according to the present invention comprises a semiglobal main chamber having an outlet pipe connected therewith, a shallow water chamber having a plurality of spirally disposed ridges for locating the water chamber in an inwardly spaced relation within the main chamber and defining a plurality of volute passageways between the main and water chambers and a cap detachably secured to the upper edge of the main chamber.

DETAILED DESCRIPTION OF THE PREFERRED EMBODIMENTS

The following is a detailed description of the best mode presently contemplated for preferred embodiments of the invention. This description is not to be taken in a limiting sense, but is made merely for the purpose of illustrating the general principles of the invention.

Figure 1:
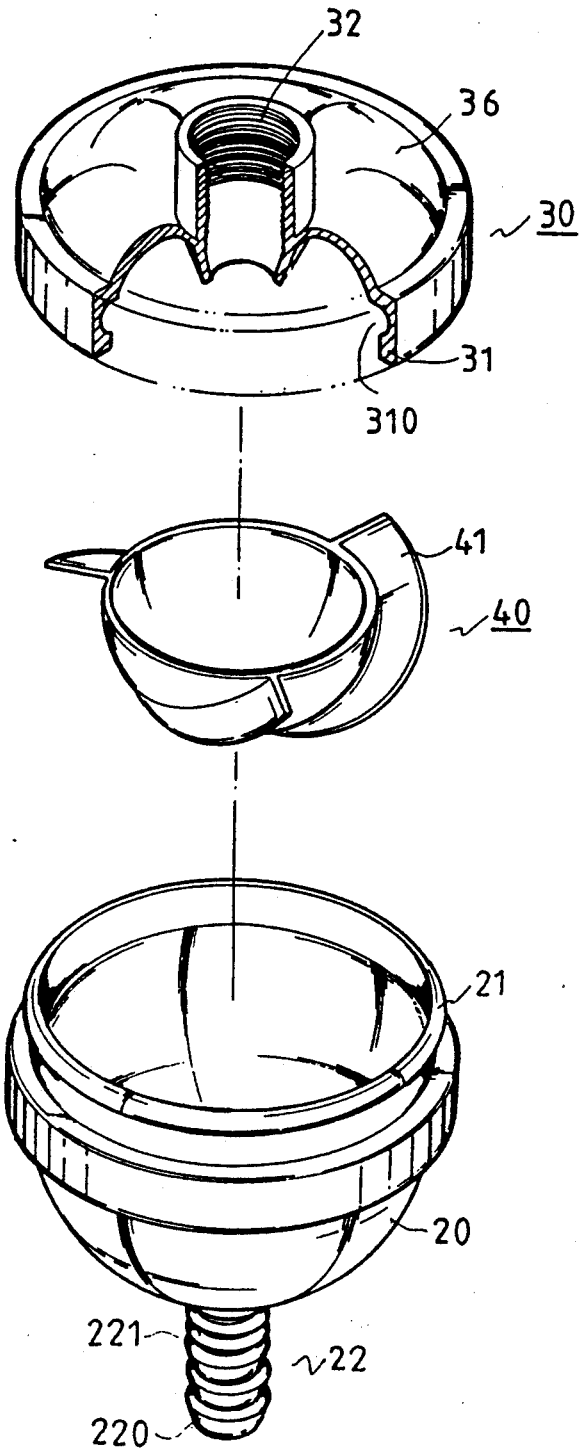
FIG. 1 is an exploded perspective view of a first embodiment according to this invention.
Figure 2:
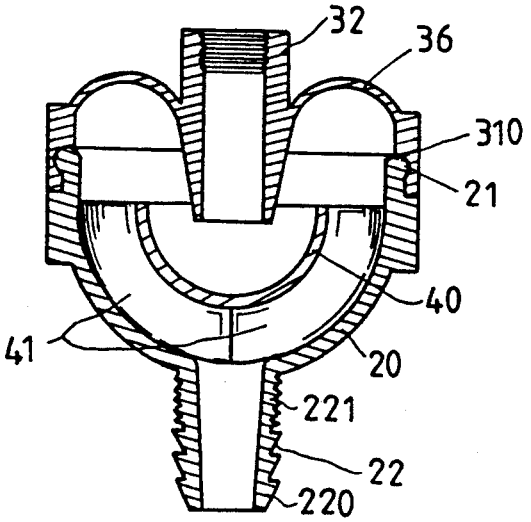
FIG. 2 is a cross-sectional view of the sink trap shown in FIG. 1.

Referring to FIGS. 1 and 2, a sink trap according to the present invention comprises a substantially semiglobal main chamber 20 with an open top, a cap 30 detachably secured to close the open top of the main chamber 20 and define an inner space in the main chamber 20 and a shallow water chamber 40 accommodated in the inner space.

The main chamber 20 is integrally formed with an outlet pipe 22 connected to the bottom thereof. Said outlet pipe 22 is formed with a thread portion 221 in an upper half and circumferencial corrugations 220 in a lower half of the circumference of the outlet pipe 22. A rim 21 is integrally formed on the top end of the main chamber 20.

The shallow water chamber 40 is integrally formed with three ridges or baffles 41 which are equally spaced and spirally disposed on the dome-shaped outer circumference of the water chamber 40. The ridges or baffles 41 are so dimensioned to support the water chamber 40 within the main chamber 20 in an inwardly spaced relation and define three volute passageways between the main and water chambers 20, 40.

The cap 30 includes a dome-shaped disc 36 and a flange 31 circumferencially formed on the outer edge of the disc 36. An annular groove 310 is formed in the inner circumference of the flange 31 to receive the rim 21 of the main chamber 20. An inlet pipe 32 extends through the cap 30 and down slightly into the water chamber 40 and is formed with an internal thread.

In assembly, as best shown in FIG. 2, the water chamber 40 is disposed within the main chamber 20 to define three volute passageways by the baffles 41 between the main and water chambers 20, 40, then the cap 30 is secured to the open top of the main chamber 20 by means of press-fitting whereas the rim 21 of the main chamber 20 being engaged in the annular groove 310 of the cap 30 and thus sealed to prevent gas and grainage from passing the same.

In use, the sink trap of the invention is attached to a waste pipe (not shown) by means of a thread engagement between the remote end of the waste pipe and inlet pipe 32 of the cap 30 and a drainage pipe (not shown) is connected to the outlet pipe 22 when drainage is led into the sink trap, the drainage will fill then overflow the shallow water chamber 40 to pass through the volute passageways defined by the baffles 41 between the main and water chambers 20, 40 and further to be discharged through the outlet pipe 22 and drainage pipe. The flow of drainage will accelerate to form a turbulent liquid flow when passing through the volute passageways so as to strengthen the drainage flow along the drainage pipe line that prevents the drainage pipe line from becoming choked with impassable matter. Moreover, as the inlet pipe 32 extends downwardly into the water chamber 40, the lower edge or outlet end of the inlet pipe 32 is permanently submerged by the water which is retained by the water chamber 40 so that the lower edge or outlet end of the inlet pipe 32 is sealed to prevent any gases or insects from passing through the inlet pipe 32.

Figure 4:
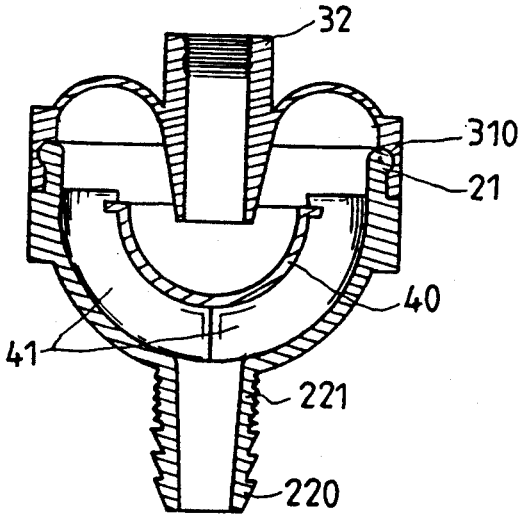
FIG. 4 is a cross-sectional view of the sink trap shown in FIG. 3.
Figure 3:
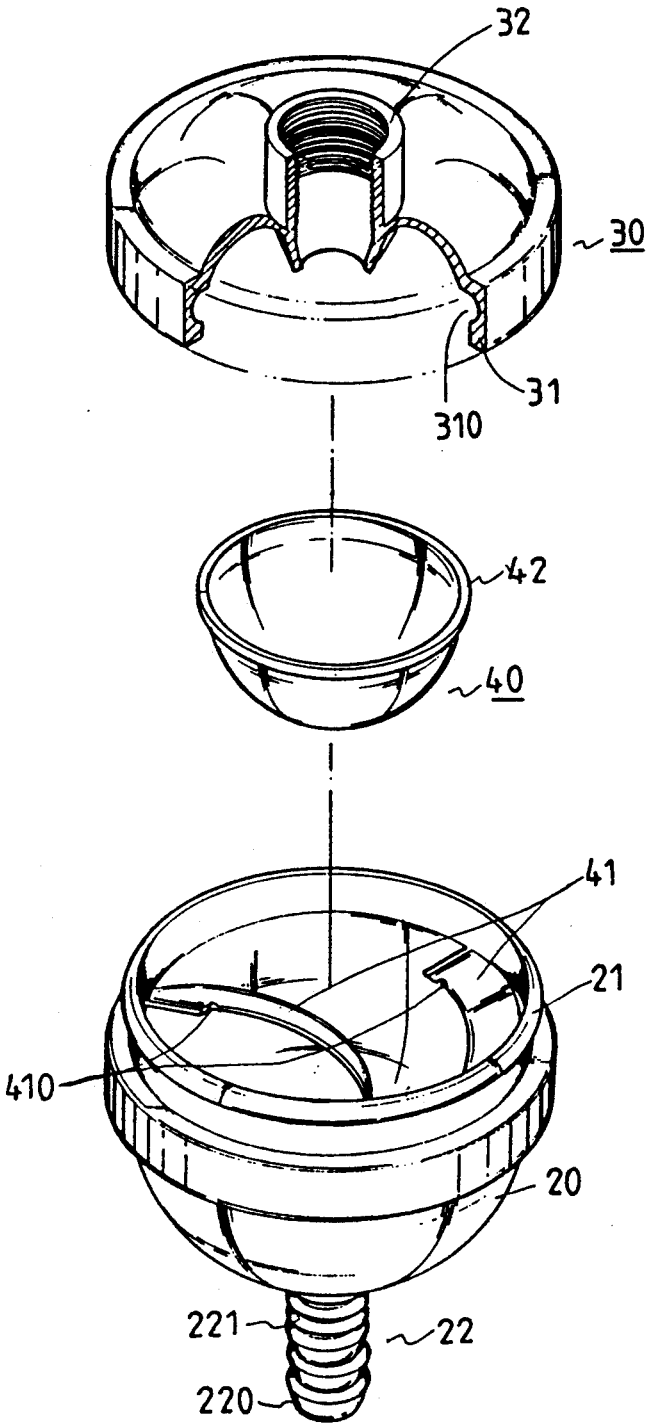
FIG. 3 is an exploded perspective view of a second embodiment according to this invention.

FIGS. 3 and 4 show an alternative embodiment of which the structure is the same as the first embodiment shown in FIGS. 1 and 2 except that the baffles 41 are spirally formed on the inner side wall of the main chamber 20 to support the shallow water chamber 40 within the main chamber 20 in an inwardly spaced relation and define three volute passageways between the main and water chambers 20, 40. Each of the baffles 41 is formed with a notch 410 at an inner top corner to correspondingly define serial grooves 410 for retaining a laterally-extended flange 42 at the upper edge of the water chamber 40.

The sink trap of this second embodiment is used in the same way as the first embodiment to prevent drainage pipe line from becoming choked with impassable matter and intrusion of insects and sewer-gas and other obnoxious vapors.

What is claimed is:

1. A sink-trap comprising:

a semi-global outer chamber defining an inner space and having a laterally-extending rim on an upper end and an outlet pipe attached to a lower end, said outlet pipe defining a first passageway communicating the inner space; a water chamber adapted to be located in the inner space of the outer chamber;

a plurality of baffle members spirally disposed on an outer circumference of the water chamber to support the water chamber within the outer chamber in an inwardly spaced relation and define a plurality of volute passageways between the outer and water chambers to communicate the the first passageway in the outlet pipe;

a cap member secured to the upper end of the outer chamber and having an annular groove for receiving the rim of the outer chamber; and an inlet pipe extending downwardly through the cap member into the water chamber.

2. A sink-trap comprising:

a semi-global outer chamber defining an inner space and having a laterally-extending rim on an upper end and an outlet pipe attached to a lower end, said outlet pipe defining a first passageway communicating the inner space;

a water chamber adapted to be located in the inner space of the outer chamber;

a plurality of baffle members spirally disposed on an inner circumference of the outer chamber to locate the water chamber within the outer chamber in an inwardly spaced relation and define a plurality of volute passageways between the outer and water chambers to communicate the first passageway in the outlet pipe;

a cap member secured to the upper end of the outer chamber and having an annular groove for receiving the rim of the outer chamber; and an inlet pipe extending downwardly through the cap member into the water chamber.

* * * * *